United States Patent [19]

Iacoviello

[11] 4,130,231

[45] Dec. 19, 1978

[54] HAMMER BLOCK

[75] Inventor: Alan Iacoviello, New Haven, Conn.

[73] Assignee: Olin Corporation, New Haven, Conn.

[21] Appl. No.: 806,785

[22] Filed: Jun. 15, 1977

[51] Int. Cl.[2] ..... B25C 1/14

[52] U.S. Cl. ..... 227/10

[58] Field of Search ..... 227/8, 9, 10, 11

[56] References Cited

U.S. PATENT DOCUMENTS 3,643,850 2/1972 Endo et al. ..... 227/8

3,929,269 12/1975 Hodil ..... 227/10

3,945,548 3/1976 Dorgnon ..... 227/8

*Primary Examiner*—Granville Y. Custer, Jr.

*Attorney, Agent, or Firm*—William W. Jones; Paul J. Lerner

[57] ABSTRACT

A safety device, for a powder-actuated tool, which prevents the tool from discharging as the result of accidental impact or dropping. A moveable blocking member retains the hammer in the cocked position, despite disengagement of the sear, until displaced to an inoperative position by manipulation of the trigger.

3 Claims, 5 Drawing Figures

HAMMER BLOCK

This invention relates to powder-actuated fastener setting tools, and specifically to a safety device for preventing the accidental discharge of such tools consequent to impact or dropping.

Powder-actuated tools, such as the fastener setting tool disclosed in U.S. Pat. No. 4,074,844 issued Feb. 21, 1978 may be subject to unintentioned discharge as a result of accidental impact thereagainst. Although the aforesaid tool is designed to discharge only when pressed against a workpiece, and then only in response to manipulation of the trigger, the peculiar impact occasioned by dropping the tool on its side may cause discharge.

It is, therefore, an object of this invention to provide a safety device for powder-actuated tools which will prevent accidental discharge. More specifically, it is an object to provide such a safety device specially adapted for use with the aforesaid fastener setting tool.

This is accomplished, in general, by the provision of a hammer block or moveable blocking member which retains the hammer in substantially the cocked position, despite disengagement of the sear, until displaced to an inoperative position by manipulation of the trigger.

With the above and other objects, as may hereinafter appear, in view, the invention may be more clearly understood with reference to the following written description and the accompanying drawings wherein.

Figure 1:
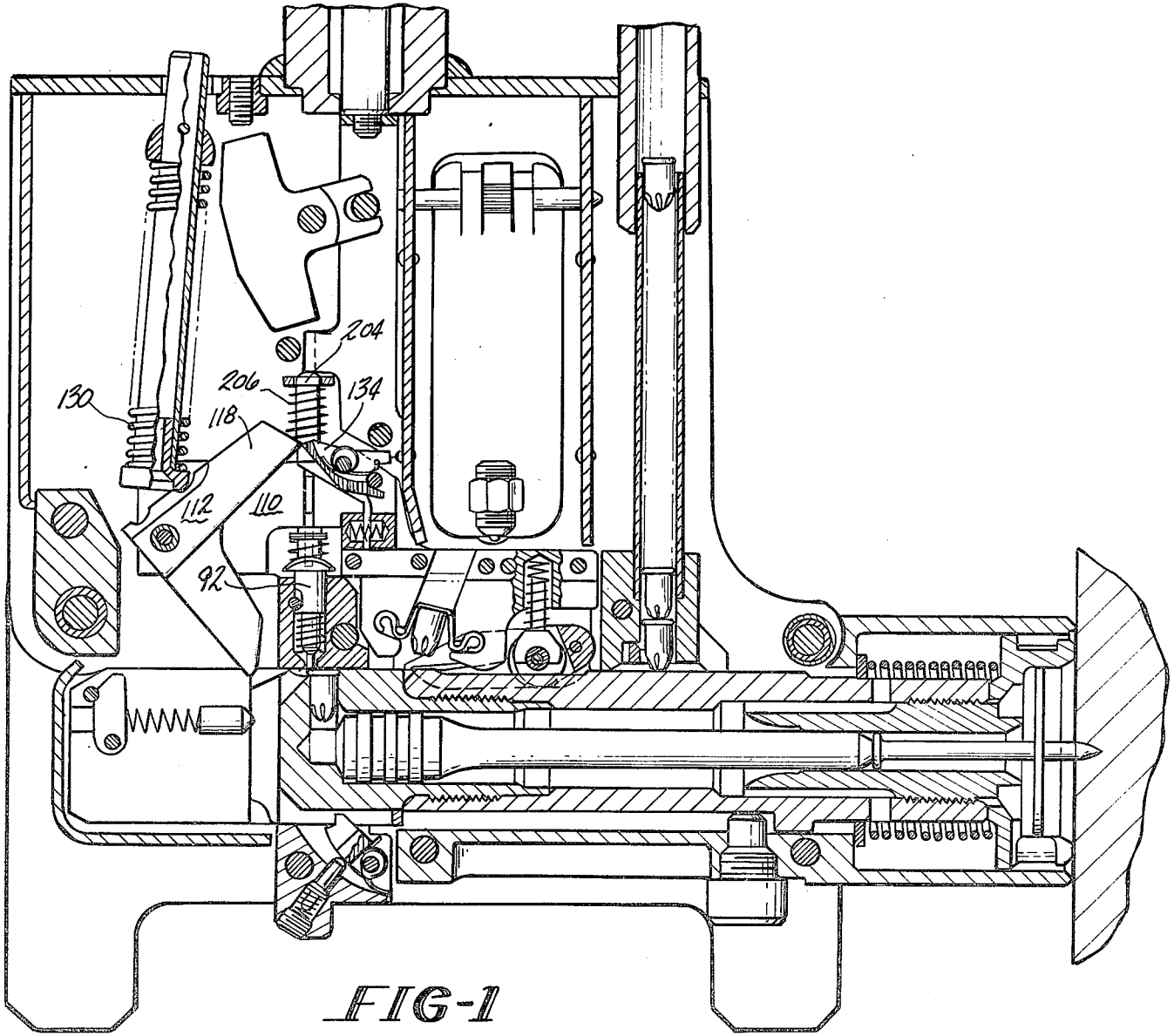
FIG. 1 is a vertical sectional view of a powder-actuated tool having incorporated therein a preferred embodiment of the safety device of the present invention.

Referring now to the drawings, the safety device is shown, in FIG. 1, incorporated in a fastener setting tool which is described in detail in U.S. Pat. No. 4,074,844. Part names and numbers employed herein correspond to those found in the aforesaid application.

The safety device includes hammer block means comprising blocking member 300 having a flat hammer-engagement surface 302 and curved intermediate and exterior camming surfaces 304 and 306 respectively. The blocking member 300 is rotatably carried, on pin 308, in longitudinal slot 310 formed in the upper trigger block rod 204. Spring 312, carried on pin 314, acts against the exterior camming surface 306, biasing the upper portion of the blocking member 300 outwardly of the upper trigger block rod 204.

Figure 4:
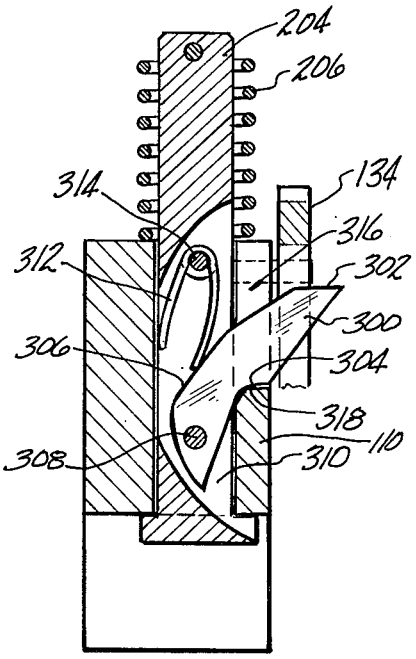
FIG. 4 is an enlarged fragmentary, vertical section view taken substantially along line 4—4 of FIG. 2, showing the blocking member in the extended position.

As described in the Hodil patent, the upper trigger block rod 204 is biased upwardly by the spring 206. With the rod 204 in the fully extended position (FIGS. 2 and 4) the slot 310 aligns with vertical opening 316 formed in the trigger plate 110, allowing the blocking member 300 to project into the path of fall of the hammer 112. As the rod 204 is depressed, the intermediate camming surface 304 rides on bottom edge 318 of the opening 316, which thereby comprises unblocking means, causing the blocking member 300 to rotate in a counter-clockwise direction, into the slot 310, until, as the rod 204 reaches the fully depressed position (FIG. 5), the blocking member 300 is completely within the slot 310 with surface 303 abutting the inner surface 111 of the trigger plate 110.

Figure 5:
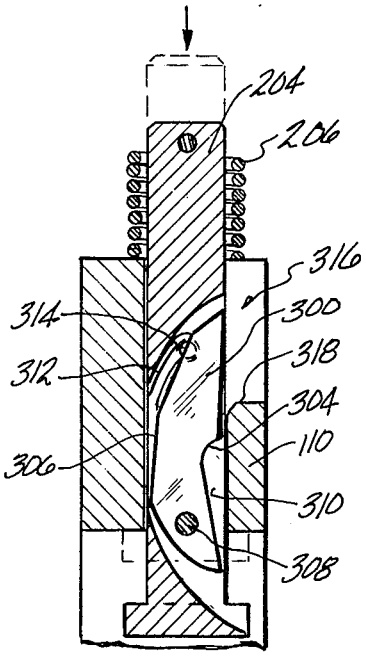
FIG. 5 is an enlarged, fragmentary, vertical sectional view, similar to FIG. 4, showing the blocking member in the retracted position.

As described fully in the Hodil patent, the upper trigger block 204 is operably connected to the trigger (not shown). To discharge the tool, the trigger is manipulated, causing inter alia, depression of the upper trigger block 204 and the resultant displacement of the blocking member 300 to the retracted, nonobstructing position (FIG. 5). The hammer 112, having been disengaged from the sear 134 by the action of the trigger mechanism, is now free to strike the firing pin 92.

Figure 2:
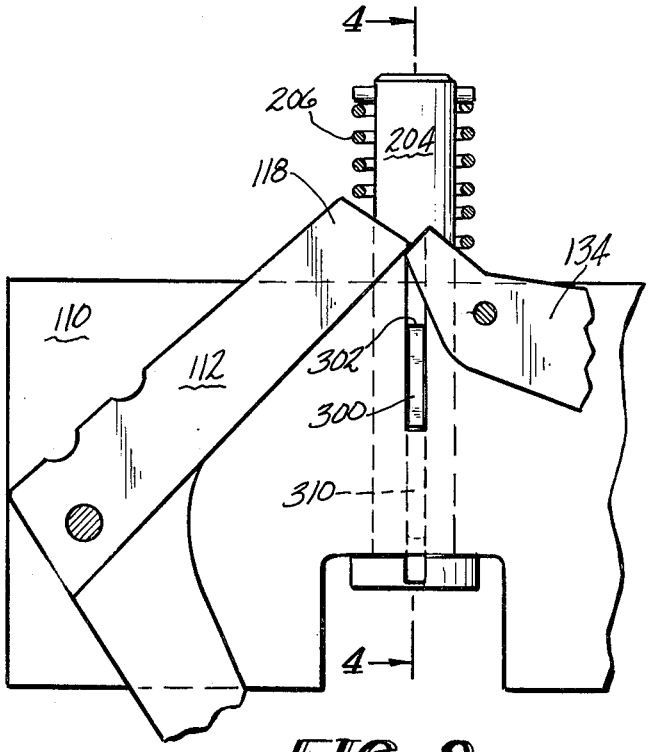
FIG. 2 is an enlarged fragmentary, vertical sectional view of the tool of FIG. 1, showing the hammer in the cocked position, retained by the sear.
Figure 3:
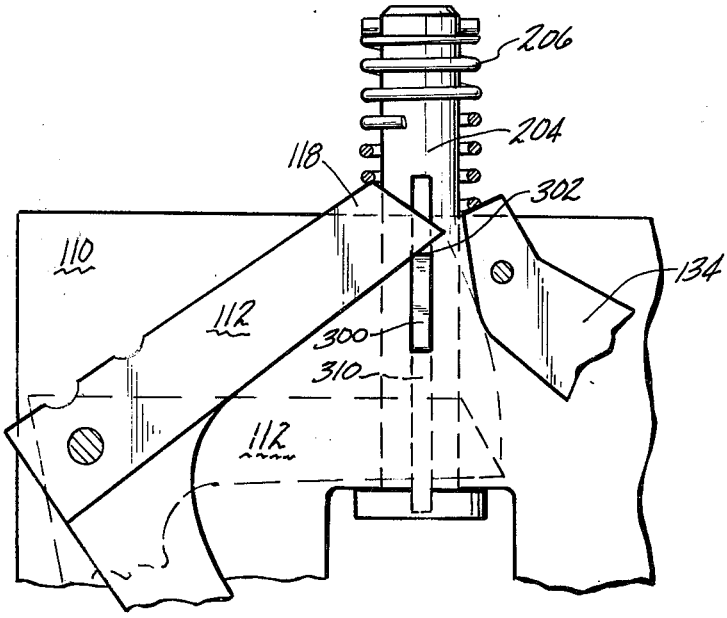
FIG. 3 is an enlarged fragmentary, vertical sectional view, similar to FIG. 2, showing the hammer disengaged from the sear and resting on the blocking member.

Turning to FIG. 2, the hammer 112 is seen in the cocked position, retained by the sear 134. In FIG. 3, the hammer 112 has been disengaged from the sear 134, as might occur consequent to an accidental impact on the tool, and has rotated, slightly, in a clockwise direction, under the influence of the hammer spring 130. The hammer 112 is now retained by the blocking member 300, with striking head 118 resting on the hammer-engagement surface 302. The hammer 112 is still, at this point, in a cocked position, but discharge of the tool is prevented until the trigger has been manipulated to retract the blocking member 300 as previously described. A positive interlock is thus provided, permitting discharge of the tool only after manipulation of the trigger.

Since many changes and variations of the disclosed embodiment of the invention may be made without departing from the inventive concept, it is not intended to limit the invention otherwise than as required by the appended claims.

I claim:

1. A safety device for use with a powder-actuated tool of the type including a housing, a barrel assembly mounted in said housing for reciprocal sliding movement with respect to said housing from a rearwardmost battery position to a forward loading position and return, a firing chamber in said barrel assembly, means carried by said housing forming a magazine adapted to receive and hold a plurality of cartridges, a hammer mounted in said housing, sear means mounted in said housing for releasably engaging said hammer in a cocked position, a trigger bar assembly extending into said housing and having a lower portion thereof engageable with said sear means to disengage the latter from said hammer when said trigger bar assembly is displaced to a firing position, and blocking means for engaging a surface on said barrel assembly to block rearward movement of said barrel assembly toward said battery position upon displacement of said trigger bar assembly to said firing position before said barrel assembly has reached said rearwardmost battery position; the safety device comprising: hammer block means, independent of said sear means, for engaging a surface on said hammer to block substantial displacement thereof from said cocked position before said displacement of said trigger bar assembly to said firing position, thereby preventing accidental impact firing of the tool, said hammer thereby preventing accidental impact firing of the tool, said hammer block means comprising a blocking member moveable between a first position, whereat substantial movement of said hammer from said cocked position is prevented, and a second position, whereat movement of said hammer is unobstructed, said blocking member being operatively connected to said trigger bar assembly whereby movement of the former from said first position to said second position is effected by displacement of the latter to said firing position.

2. In a powder-actuated tool of the type comprising a housing, a barrel assembly mounted in said housing for reciprocal movement with respect to said housing between a battery position and a loading position, a firing chamber in said barrel assembly, firing means in said housing, said firing means including a hammer, a sear lever mounted in said housing for pivotal movement between a first position and a second position and return, said sear lever being biased toward said second position, and said sear lever including a means thereon positioned for engagement with a surface on said barrel assembly to pivot said sear lever to said first position only when said barrel assembly is moved to said battery position, sear means pivotally mounted on said sear lever for engagement with said hammer to retain the latter in a cocked position, said sear means providing a maximum extent of engagement with said hammer when said sear lever is in said second position and a minimum extent of engagement with said hammer when said sear lever is in said first position, said trigger means mounted on said housing for manual actuation to disengage said rear means for said hammer only when said sear means is in minimum engagement with said hammer; the improvement comprising: a moveable blocking member operative to retain said hammer substantially in said cocked position, whereby accidental discharge of said tool occasioned by impact thereagainst is prevented, and unblocking means for rendering said blocking member inoperative, sad unblocking means being operatively connected to said trigger means thereby actuation of said trigger means renders said blocking member inoperative to retain said hammer in said cocked position.

3. A safety device for use with a powder-actuated tool of the type including a housing, a barrel assembly mounted in said housing for reciprocal movement with respect to said housing between a battery position and a loading position, a firing chamber in said barrel assembly, firing means in said housing, said firing means including a hammer, a sear lever mounted in said housing for pivotal movement between a first position and a second position and return, said sear lever being biased toward said second position, and said sear lever including means thereon positioned for engagement with a surface on said barrel assembly to pivot said sear lever to said first position only when said barrel assembly is moved to said battery position, sear means pivotally mounted on said sear lever for engagement with said hammer to retain the latter in a cocked position, said sear means providing a maximum extent of engagement with said hammer when said sear lever is in said second position, and a minimum extent of engagement with said hammer when said sear lever is in said first position, and trigger means mounted on said housing for manual actuation to disengage said sear means from said hammer only when said sear means is in minimum engagement with said hammer; the device comprising: a moveable blocking member having a first position whereat substantial movement of said hammer from said cocked position is prevented and a second position whereat said movement of said hammer is unobstructed, and unblocking means, operatively connected to said trigger means, for displacing said blocking member from said first position to said second position.

* * * * *

UNITED STATES PATENT OFFICE

CERTIFICATE OF CORRECTION

Patent No. 4,130,231 Dated Dec. 19, 1978

Inventor(s) Alan Iacoviello

It is certified that error appears in the above-identified patent and that said Letters Patent are hereby corrected as shown below:

Col. 3, line 30: the word "rear" should read --sear--.

Col. 4, line 1: the word "thereby" should read --whereby--.

Signed and Sealed this

*Twenty-eighth* Day of *October 1980*

[SEAL]

*Attest:*

SIDNEY A. DIAMOND

*Attesting Officer*

*Commissioner of Patents and Trademarks*